United States Patent [19]

Muraji

[11] Patent Number: 4,765,932

[45] Date of Patent: Aug. 23, 1988

[54] FUEL SUPPLY DEVICE FOR CARBURETORS

[75] Inventor: Tetsuo Muraji, Odawara, Japan

[73] Assignee: Mikuni Kogyo Kabushiki Kaisha, Tokyo, Japan

[21] Appl. No.: 94,586

[22] Filed: Sep. 9, 1987

[30] Foreign Application Priority Data

Sep. 10, 1986 [JP] Japan ..... 61-138632[U]

[51] Int. Cl.[4] ..... F02M 7/16

[52] U.S. Cl. ..... 261/27; 261/44.4; 261/59; 261/69.1; 261/121.4; 261/DIG. 74

[58] Field of Search ..... 261/27, 44.4, 59, 69.1, 261/121.4, DIG. 74

[56] References Cited

U.S. PATENT DOCUMENTS

| | | | |
|---|---|---|---|
| 3,198,498 | 8/1965 | Mennesson | 261/27 |
| 3,286,998 | 11/1966 | Mennesson | 261/27 |
| 3,710,771 | 1/1973 | Cinquegrani | 261/27 |
| 4,071,585 | 1/1978 | Konishi et al. | 261/44.4 |
| 4,084,562 | 4/1978 | Eckert | 261/44.4 |
| 4,484,557 | 11/1984 | Matsubara | 261/44.4 |

FOREIGN PATENT DOCUMENTS 0207796 7/1987 European Pat. Off. .

*Primary Examiner*—Tim Miles
*Attorney, Agent, or Firm*—Lalos & Keegan

[57] ABSTRACT

A fuel supply device for carburetors comprising a fuel passageway opened at one end in a variable venturi and connected to a float chamber through a jet; a solenoid valve and/or fuel pump provided within the fuel passageway; a negative pressure passageway opened at one end in a stationary venturi located on the upstream side of the variable venturi and generating a negative pressure weaker than in the variable venturi and having an upright part connected to the fuel passageway between the jet and the fuel pump; a level sensor provided in a predetermined height position of the upright part of the negative pressure passageway and capable of detecting whether or not a fuel column formed in the upright part is in a predetermined position and; a control circuit capable of controlling the operation of the solenoid valve and fuel pump on the basis of the output from the level sensor in order to make it possible to maintain the air-fuel ratio in a high load range to be proper without enlarging the flow resistance within the suction bore so that the operation of the fuel pump and solenoid valve may be controlled by the level sensor and control circuit so that the fuel column may maintain the predetermined height.

11 Claims, 3 Drawing Sheets

FUEL SUPPLY DEVICE FOR CARBURETORS

BACKGROUND OF THE INVENTION (a) Field of the Invention

This invention relates to a fuel supply device for carburetors and more particularly to a fuel supply device wherein an air-fuel ratio of a mixture to be supplied to an engine is kept proper by controlling the fuel flow rate so that the height of the fuel column to be formed within a negative pressure passageway for detecting the sucked air flow rate communicating with a fuel passageway may be kept at a predetermined value.

(b) Description of the prior art

A conventional fuel supply device of this kind is mentioned in European patent publication No. 0207796 filed previously by the applicant of the present application. In this device, a solenoid valve is arranged in the course of a fuel passageway opening at one end to a variable venturi part of a suction bore and communicating at the other end with a fuel supply source through a jet, a liquid level sensor is arranged in the course of a negative pressure passageway opening at one end to a stationary venturi part generating a negative pressure lower than the negative pressure generated by the variable venturi on the upstream side of the variable venturi and communicating at the other end with the fuel passageway between the above-mentioned jet and the solenoid valve and a control circuit controlling the opening and closing of the solenoid valve by receiving a signal from the liquid level sensor so that the height of the fuel column to be formed within a negative pressure passageway may be fixed is provided.

Now, there has been a problem that, in the case of the above-mentioned conventional device, when the amount of air to be sucked increases in a high load range and the air passing area, that is, the valve opening degree becomes large, the pressure difference between the variable venturi and the stationary venturi will become so small that, even if the solenoid valve is fully opened, the fuel column within the negative pressure passageway will not be able to be lowered, the fuel will be delivered into the suction bore from the negative pressure passageway and the air-fuel ratio of the mixture will be no longer able to be controlled. If the valve opening degree in the variable venturi is limited, this problem will be solved but the flow resistance within the suction bore will become so large as to be undesirable.

SUMMARY OF THE INVENTION

In view of the above-mentioned problem, a primary object of the present invention is to provide a fuel supply device for carburetors wherein the air-fuel ratio control in a high load range is mantained to be proper without enlarging the resistance within a suction bore.

Another object of the present invention is to provide a carburetor which is low in cost and which can always positively supply a mixture having an air-fuel ratio adapted to the operation of the engine.

According to the present invention, these objects can be attained by being provided with a fuel pump provided in the course of a fuel passageway opened at one end to a variable venturi of a suction bore and connected at the other end to a fuel supply source through a jet, a negative pressure passageway opened at one end to a stationary venturi provided on the upstream side of the variable venturi and capable of generating negative pressure lower than in the variable venturi, connected at the other end to the fuel passageway between the jet and the fuel pump and having an upright part between both ends, a level sensor set in a predetermined height position of the upright part of the negative pressure passageway and a control circuit capable of varying the output of the fuel pump so that the fuel column to be formed in the upright part of the negative pressure passageway may be maintained at a predetermined height on the basis of the output signal from the level sensor.

According to a preferred formation of the present invention, a solenoid valve is provided in the fuel passageway on the delivery side of the fuel pump. In this solenoid valve, too, the valve opening rate (valve opening/closing ratio) is controlled so that the above-mentioned fuel column may be maintained at a predetermined height on the basis of the output from the level sensor by another control circuit. In such case, the output of the fuel pump is so related as to vary in response to the valve opening rate of the solenoid valve.

According to another preferred formation of the present invention, a solenoid valve is provided in a bleed air passageway to lead bleed air into the fuel passageway on the delivery side of the fuel pump and the valve opening rate of this solenoid valve is controlled in response to the output of the fuel pump.

According to still another preferred formation of the present invention, the variable venturi is formed of a piston valve or plate valve capable of being operated by a negative pressure generated therein.

These and other objects as well as the features and advantages of the present invention will be apparent from the following detailed description of the preferred embodiments when taken in conjunction with the accompanying drawings.

DESCRIPTION OF THE PREFERRED EMBODIMENTS

Figure 1:
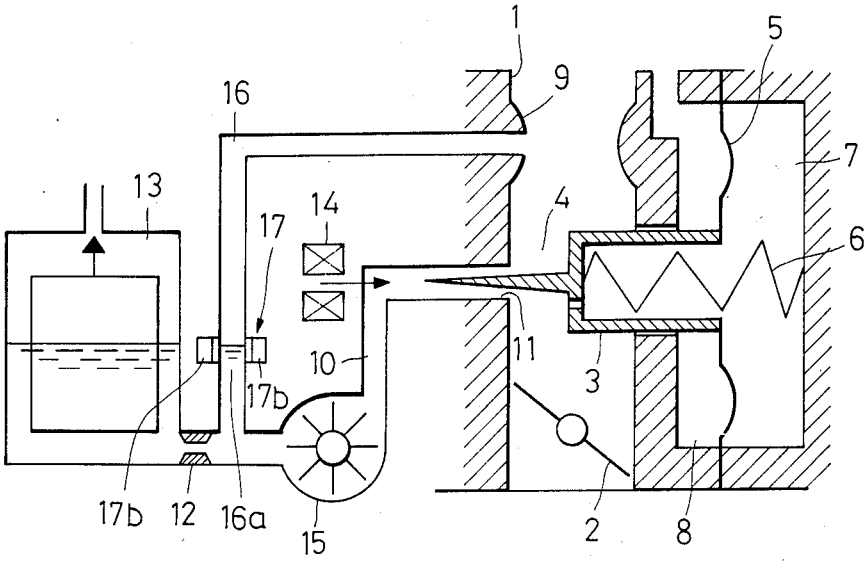
FIG. 1 is a sectional view of the first embodiment of a fuel supply device according to the present invention.

FIG. 1 is a sectional view showing a structure of the first embodiment of the present invention. The reference numeral 1 represents a suction bore of a carburetor, 2 represents a throttle valve set within the suction bore 1, 3 represetns a piston valve arranged slidably in the direction intersecting at right angles with the suction bore 1 on the upstream side of the throttle valve 2 and forming a variable venturi 4, 5 represents a diaphragm connected to the rear end of the piston valve 3, 6 represents a spring biased in the direction of closing the piston valve 3, that is, the direction in which the variable venturi 4 becomes smaller, 7 represents a negative pressure chamber communicating with the variable venturi 4, and 8 represents an atmospheric pressure chamber. The reference numeral 9 represents a stationary venturi formed on the upstream side of the movable venturi 4 and generating a negative pressure lower than in the variable venturi 4 and 10 represents a fuel passageway opening at one end to the variable venturi 4 through a main nozzle 11, communicating at the other end with a float chamber 13 as a fuel supply source through a jet 12, having a solenoid valve 14 arranged in the course and further having a fuel pump 15 arranged on the upstream side of the solenoid valve 14. The reference numeral 16 represents a negative pressure passageway opened at one end to the stationary venturi 9, communicating at the other end between the jet 12 of the fuel passageway 10 and the fuel pump 15 and having an upright part made, for example, of a transparent tube. The reference numeral 17 represents a known level sensor arranged in the position of a predetermined height of the upright part and made of a combination, for example, of a light emitting element 17*a* and a light receiving element 17*b* so that, in response to whether the level of the fuel column 16*a* is higher or lower than the predetermined height position, the output may be large or small. A level sensor of any of such known types as a float switch type and magnetic type can be used.

Figure 2:
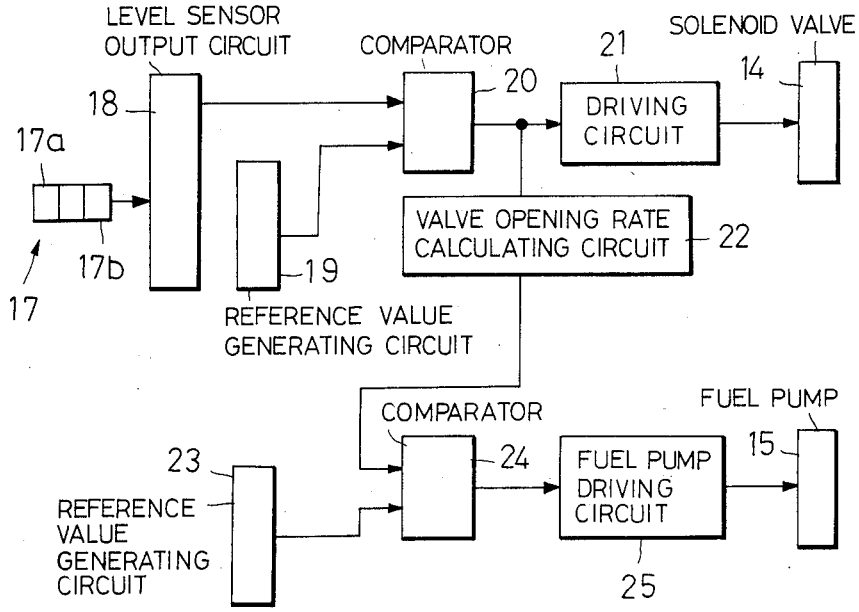
FIG. 2 is a block diagram of a control circuit of the above-mentioned first embodiment.

FIG. 2 is a block diagram of a control circuit of the above-mentioned solenoid valve 14 and fuel pump 15. The reference numeral 18 represents a level sensor output circuit connected to the light receiving element 17*b*, 19 represents a reference value generating circuit and 20 represents a comparator, 21 represents a driving circuit for the solenoid valve 15. In the comparator 20, a pulse of a width proportional to the difference between the output from the level sensor output circuit 18 and the reference value output by the reference value generating circuit 19 is output and, in the driving circuit 21, the solenoid valve 14 is duty-controlled in response to the width of the output pulse of the comparator 20. The reference numeral 22 represents a valve opening rate calculating circuit, 23 represents another reference value generating circuit, 24 represents a comparator and 25 represents a fuel pump driving circuit. An output corresponding to the width of the output pulse of the comparator 20 is output from the valve opening rate calculating circuit 22. An output proportional to the difference between the output of the valve opening rate calculating circuit 22 and the reference value output by the reference value generating circuit 23 is output from the comparator 24. The output of the fuel pump 15 is varied in response to the output of the comparator 24 in the fuel pump driving circuit 25.

The operation of the above-mentioned device shall be explained in the following.

When the level of the fuel column 16*a* within the negative pressure passageway is lower than a predetermined height, that is, when the flow rate of fuel flowing through the fuel passageway is so high that the fuel pressure is lower than the set value, the fuel flow rate will be so higher than the air flow rate corresponding to the negative pressure generated in the stationary venturi 9 that the produced mixture will be too thick. On the other hand, at this time, the output from the level sensor output circuit 18 will be so small that the difference from the reference value will be small and therefore the width of the output pulse of the comparator 20 will become also small. Therefore, the duty ratio, that is, the opening degree of the solenoid valve 14 controlled by the driving circuit 21 will become small. Also, at this time, the output of the valve opening rate calculating circuit 22 will be so small that the difference from the reference value will become small and therefore the output of the comparator 24 will become small. Therefore, the output of the fuel pump 15 controlled by the driving circuit 25 will become small. From the above result, the fuel flow rate through the fuel passageway 10 will reduce, the pressure difference between the upstream side and the downstream side of the jet 12 will become small and the downstream side pressure of the jet 12 will rise to elevate the level of the fuel column 16*a*.

On the other hand, when the level of fuel column 16*a* within the negative pressure passageway 16 is higher than the predetermined position, that is, when, contrary to the above, the flow rate of fuel flowing through the fuel passageway 10 is so small that the fuel pressure is higher than the set value, the fuel flow rate will be so lower than the air flow rate corresponding to the negative pressure generated in the stationary venturi 9 that the produced mixture will be too thin. Thus, the output from the level sensor output circuit 18 will become so large and the width of the output pulse of comparator 20 will also become so large that the duty ratio, that is, the opening degree of the solenoid valve 14 will become large. Also, at this time, the output of the valve opening rate calculating circuit 22 will become so large that the output of the fuel pump 15 will become large. Therefore, the fuel flow rate through the fuel passageway 10 will become so high that the pressure difference between the upstream side and downstream side of the jet 12 will become large and the pressure on the downstream side of the jet will fall to reduce the height of the fuel column 16*a*.

Thus, when both operations mentioned above are alternately repeated, the conditions of keeping the height of the fuel column 16*a* within the negative pressure passageway 16 at the predetermined height will be satisfied and, even if the air flow volume flowing through the suction bore varies, the air-fuel ratio of the mixture supplied to the engine will be always kept constant.

Now, in the conventional device, when the sucked air flow rate increases to be so high in the high load range that the opening degree of the piston valve 3 in the variable venturi 4 becomes high, the pressure difference between the variable venturi 4 and the stationary venturi 9 will become so small that, even if the solenoid vlave is fully opened, the level of the fuel column 16*a* will no longer lower. However, in the device of the present invention, as described above, as the output of the fuel pump 15 is varied in response to the opening degree of the solenoid valve 14 to forcibly feed the fuel without depending only on the negative pressure produced in the variable venturi, when the solenoid valve 14 is fully opened, the fuel flow rate will be also maximum and the pressure difference between the upstream side and downstream side of the set 12 will be also maximum. Therefore, the pressure on the downstream side of the jet 12 will be minimum, the height of the fuel column 16*a* will be lowered to be kept on a constant level and therefore the air-fuel ratio control in the high load range will be maintained to be proper. In this case, as the size of the variable venturi 4, that is, the opening degree of the piston valve 3 need not be regulated, the resistance within the suction bore 1 will not become large. This is desirable to the output increase.

Figure 3:
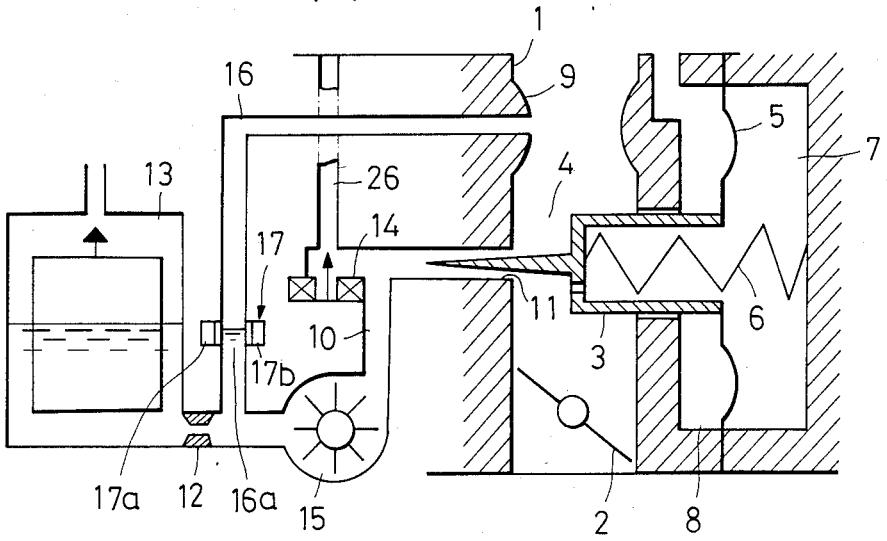
FIGS. 3 and 4 are sectional views respectively of the second and third embodiments according to the present invention.

FIG. 3 is a sectional view of the second embodiment. In this embodiment, instead of providing the solenoid valve 14 within the fuel passageway 10, a bleed air passageway 26 is provided and the solenoid valve 14 is arranged in the bleed air passageway 26. In this case, too, the control circuit in FIG. 2 is utilized as it is but, in respect that only the fuel pump 15 is used to maintain the fuel column 16*a* at the predetermined height and the bleed air adapted to the fuel volume delivered by the fuel pump 15 is led by the solenoid valve 14 into the fuel passageway 10, this second embodiment is different from the first embodiment. According to this second embodiment, there is an advantage that, in any operating conditions, the fuel can be very efficiently atomized.

Figure 4:
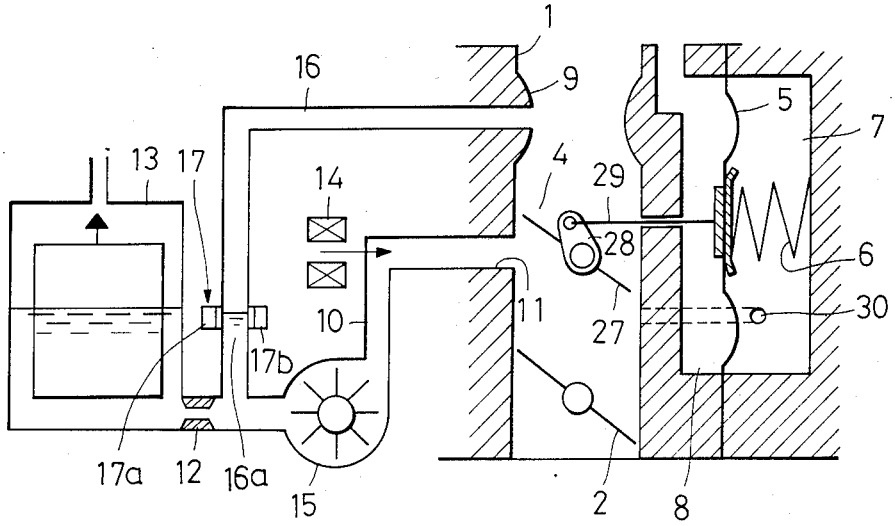

FIG. 4 is a sectional view of the third embodiment. In this embodiment, a plate valve 27 is provided instead of the piston valve 3 to form the variable venturi and is connected to the diaphragm 5 through a lever 28 and connecting rod 29 and the negative pressure chamber 7 is made to communicate with the variable venturi 4 through a passageway 30. The other formations and operations of this embodiment are the same as in the first embodiment and therefore shall not be further explained. This embodiment has an advantage that the carburetor can be made more cheaply than in the case of using the piston valve 3.

Figure 5:
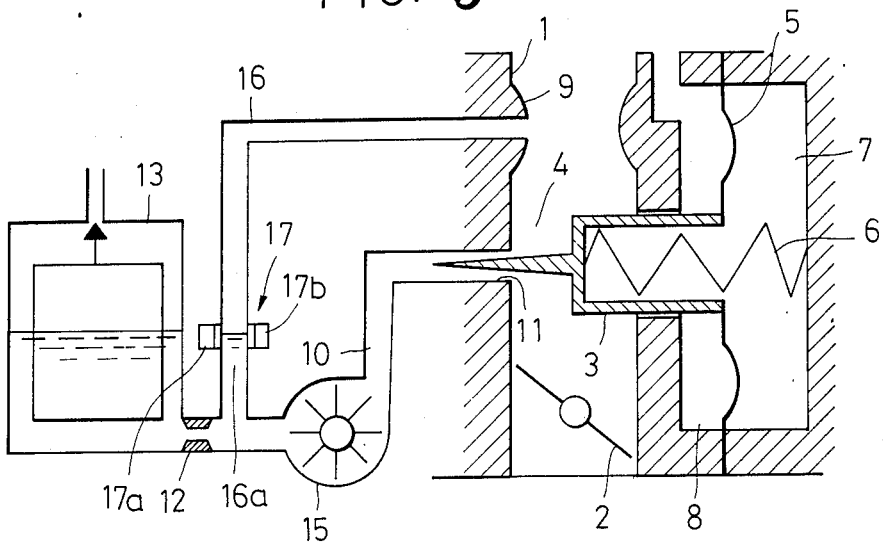
FIGS. 5 and 6 are respectively a sectional view of the fourth embodiment and a block diagram of a control circuit according to the present invention.
Figure 6:
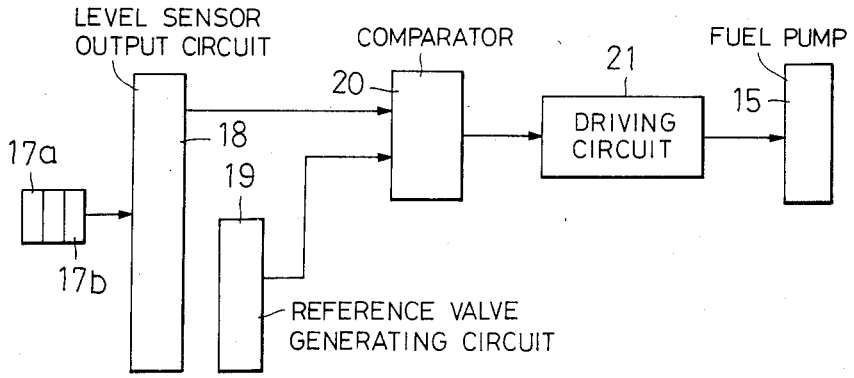

FIGS. 5 and 6 are respectively a sectional view of the fourth embodiment and a block diagram of a control circuit. In this embodiment, the solenoid valve 14 is abolished and the fuel flow rate is controlled with only the fuel pump 15.

The operation of this embodiment will be able to be easily understood with reference to the operation of the first embodiment and therefore shall not be explained. This embodiment can be preferably utilized for a compact type carburetor.

It will be able to be easily understood that the plate valve 27 shown in FIG. 4 can be used instead of the piston valve 3 also in the embodiments shown in FIGS. 3 and 5.

What is claimed is:

1. A fuel supply device for carburetors comprising a suction bore having therein a stationary venturi and a variable venturi provided on the downstream side of said stationary venturi and made capable of generating a negative pressure higher than in said stationary venturi; a fuel passageway opened at one end in said variable venturi and connected at the other end to a fuel supply source through a jet; a fuel flow rate controlling means provided in the course of said fuel passageway to control the fuel flow rate through said fuel passageway; a negative pressure passageway opened at one end in said stationary venturi, connected at the other end to said fuel passageway between said jet and fuel flow rate controlling means and having an upright part between both ends; a level sensor arranged adjacent to said negative pressure passageway in a predetermined height position of the upright part of said negative passageway; a fuel pump provided within the fuel passageway between the connecting part of said fuel passageway with the negative pressure passageway and said fuel flow rate controlling means; a first control circuit connected between said level sensor and said fuel flow rate controlling means and capable of controlling the operation of said fuel flow rate controlling means so that the fuel column to be formed in the upright part of said negative pressure passageway by receiving an output signal from said level sensor may be maintained at said predetermined height; and a second control circuit connected to said first control circuit and said fuel pump and capable of varying the output of said fuel pump in response to the fuel flow rate to be determined by said fuel flow rate controlling means.

2. A fuel supply device according to claim 1, wherein said fuel flow rate controlling means is a solenoid valve capable of varying the valve opening rate.

3. A fuel supply device according to claim 1 or 2, wherein said variable venturi is formed of a piston valve capable of being operated by the negative pressure generated in said variable venturi.

4. A fuel supply device according to claim 1 or 2, wherein said variable venturi is formed of a plate valve capable of being operated by the negative pressure generated in said variable venturi.

5. A fuel supply device for carburetors comprising a suction bore having therein a stationary venturi and a variable venturi provided on the downstream side of said stationary venturi and made capable of generating a negative pressure higher than in said stationary venturi; a fuel passageway opened at one end in said variable venturi and connected at the other end to a fuel supply source through a jet; a bleed air passageway connected at one end to said fuel passageway and opened at the other end to the atmosphere; a bleed air flow rate controlling means provided in said bleed air passageway to control the flow rate of the bleed air to be led into said fuel passageway; a negative pressure passageway opened at one end to said stationary venturi, connected at the other end to said fuel passageway between the connecting part of said fuel passageway with the bleed air passageway and said jet and having an upright part between both ends; a level sensor arranged adjacent to said negative pressure passageway in a predetermined height position of the upright part of said negative pressure passageway; a fuel pump provided within the fuel passageway between the connecting part of said fuel passageway with the negative pressure passageway and the connecting part of said fuel passageway with the bleed air passageway; a first control circuit connected to said level sensor and said fuel pump and capable of controlling the output of said fuel pump so that the fuel column to be formed in the upright part of said negative pressure passageway by receiving an output signal from said level sensor may be maintained at said predetermined height; and a second control circuit connected to said first control circuit and bleed air flow rate controlling means and capable of controlling the operation of said bleed air flow rate controlling means in response to the fuel flow rate to be determined by said fuel pump.

6. A fuel supply device according to claim 5, wherein said bleed air flow rate controlling means is a solenoid valve capable of varying the valve opening rate.

7. A fuel supply device according to claim 5 or 6, wherein said variable venturi is formed of a piston valve capable of being operated by the negative pressure generated in said variable venturi.

8. A fuel supply device according to claim 5 or 6 wherein said variable venturi is formed of a plate valve capable of being operated by the negative pressure generated in said vairable venturi.

9. A fuel supply device for carburetors comprising a suction bore having therein a stationary venturi and a variable venturi provided on the downstream side of said stationary venturi and made capable of generating a negative pressure higher than in said stationary venturi; a fuel passageway opened at one end in said variable venturi and connected at the other end to a fuel supply source through a jet; a fuel pump provided in the course of said fuel passageway to control the fuel flow rate through said fuel passageway; a negative pressure passageway opened at one end in said stationary venturi, connected at the other end to said fuel passageway between said jet and fuel pump and having an upright part between both ends; a level sensor arranged adjacently to said negative pressure passageway in a predetermined height position of the upright part of said negative pressure passageway; and a control circuit connected between said level sensor and said fuel pump and capable of controlling the output of said fuel pump so that the fuel column to be formed in the upright part of said negative pressure passageway by receiving an output signal from said level sensor may be maintained at said predetermined height.

10. A fuel supply device according to claim 9, wherein said variable venturi is formed of a piston valve capable of being operated by the negative pressure generated in said variable venturi.

11. A fuel supply device according to claim 9, wherein said variable venturi is formed of a plate valve capable of being operated by the negative pressure generated in said variable venturi.

* * * * *